United States Patent [19]

Minter

[11] Patent Number: 4,972,638

[45] Date of Patent: Nov. 27, 1990

[54] SKYLIGHT FLASHING

[75] Inventor: Mearl Minter, Oskaloosa, Iowa

[73] Assignee: Rolscreen Company, Pella, Iowa

[21] Appl. No.: 341,622

[22] Filed: Apr. 21, 1989

[51] Int. Cl.[5] ..... E04B 7/18

[52] U.S. Cl. ..... 52/200; 52/58; 52/420

[58] Field of Search ..... 52/200, 58, 420

[56] References Cited

U.S. PATENT DOCUMENTS

| | | | |
|---|---|---|---|
| Re. 32,539 | 11/1987 | Jentoft et al. | 52/200 |
| 1,983,494 | 12/1934 | Fischer | 52/420 |
| 3,003,288 | 10/1961 | Leibrook et al. | 52/420 |
| 3,034,260 | 5/1962 | Wasserman | 50/52 |
| 3,111,786 | 11/1963 | Wasserman | 50/16 |
| 3,139,702 | 7/1964 | Wasserman | 52/200 |
| 3,247,632 | 4/1966 | Bloxsom | 52/200 |
| 3,393,471 | 7/1968 | Skowlund et al. | 49/485 |
| 3,399,500 | 9/1968 | Shapiro | 52/1 |
| 3,440,779 | 4/1969 | Helma | 52/97 |
| 3,521,414 | 7/1970 | Malissa | 52/200 X |
| 4,073,097 | 2/1978 | Jentoft et al. | 52/22 |
| 4,080,763 | 3/1978 | Naidus et al. | 52/200 |
| 4,154,028 | 5/1979 | Spaulding | 52/60 |
| 4,193,237 | 3/1980 | Jankowski | 52/200 |
| 4,307,549 | 12/1981 | Clanton | 52/200 |
| 4,386,488 | 6/1983 | Gibbs | 52/58 X |
| 4,439,962 | 4/1984 | Jentoft et al. | 52/200 |
| 4,449,340 | 5/1984 | Jentoft et al. | 52/200 |
| 4,455,799 | 6/1984 | Jentoft et al. | 52/200 |
| 4,468,899 | 9/1984 | Miller | 52/200 X |
| 4,527,368 | 7/1985 | Jentoft | 52/200 |
| 4,527,368 | 7/1985 | Jentoft | 52/200 |
| 4,570,394 | 2/1986 | Jentoft et al. | 52/200 X |
| 4,589,238 | 5/1986 | Sampson et al. | 52/200 |
| 4,666,785 | 5/1987 | Crepeau | 52/58 X |
| 4,703,592 | 11/1987 | Sampson et al. | 52/200 |
| 4,781,008 | 11/1988 | Lyons, Jr. | 52/58 X |

FOREIGN PATENT DOCUMENTS

| | | | |
|---|---|---|---|
| 689527 | 6/1964 | Canada | 52/200 |
| 1088266 | 10/1980 | Canada | 20/21 |
| 1369112 | 6/1964 | France | 52/200 |
| 315248 | 9/1956 | Switzerland | 52/200 |

*Primary Examiner*—David A. Scherbel
*Assistant Examiner*—Deborah M. Ripley
*Attorney, Agent, or Firm*—Zarley, McKee, Thomte, Voorhees & Sease

[57] ABSTRACT

A one piece flexible elastomer boot membrane flashing of EPDM extends from the roof upwardly around the wood base frame and over the top edge to provide a complete seal for a skylight window unit. A tape seals the outer edges of the outwardly extending peripheral lower flange portion of the boot to the roof. The skylight may be either of the fixed or ventilator type.

4 Claims, 5 Drawing Sheets

SKYLIGHT FLASHING

BACKGROUND OF THE INVENTION

A common problem with skylight windows in roofs is providing a reliable seal against moisture passing through the opening in the roof provided for the skylight. Flashing of various types around the skylight have been used and have met with limited success in providing a moisture seal between the skylight and the roof.

SUMMARY OF THE INVENTION

The skylight flashing of this invention is comprised of a one piece flexible elastomer boot membrane which is snuggingly fitted around the base frame positioned in the roof opening on which the skylight window assembly is mounted. An elastomer material, preferably EPDM rubber, provides a higher resistance to thermal expansion and contraction. The flashing boot has a laterally outwardly extending lower peripheral portion overlapping the roof and sealed thereto by a tape overlapping the lower peripheral edge of the flashing and the roof. The flashing includes an upper laterally inwardly extending portion which overlaps the top edge of the base frame. In the case of the fixed skylight, the upper flashing portion engages the glazing directly and forms a seal. In the case of the vented skylight, the upper laterally inwardly extending flashing portion engages a support on the upstanding base frame. In either case, a complete foolproof seal is provided around the roof base frame and roof opening provided for the skylight assembly.

DESCRIPTION OF THE PREFERRED EMBODIMENT

Figure 1:
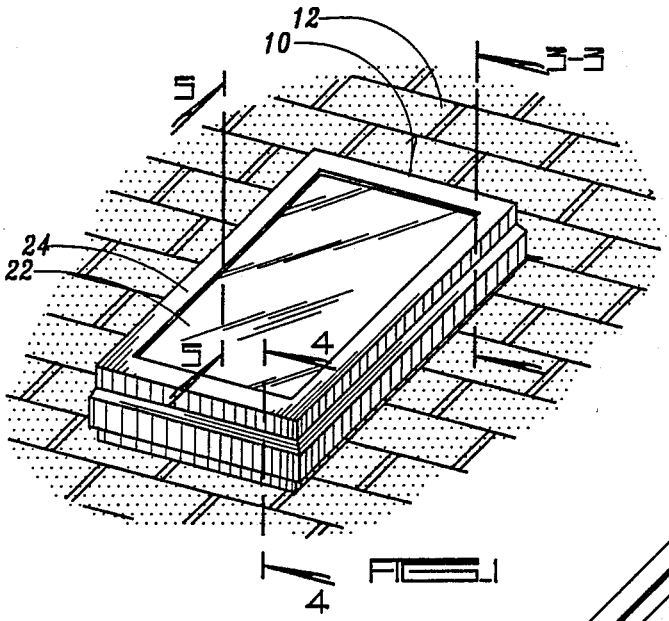
FIG. 1 is a fragmentary perspective view of a fixed skylight in a roof.

The fixed skylight of this invention is referred to generally in FIGS. 1–5 by the reference numeral 10 and is shown mounted on a roof 12 having an opening 14 in which an upstanding wood base frame 16 is positioned by L-shaped brackets 18.

Figure 2:
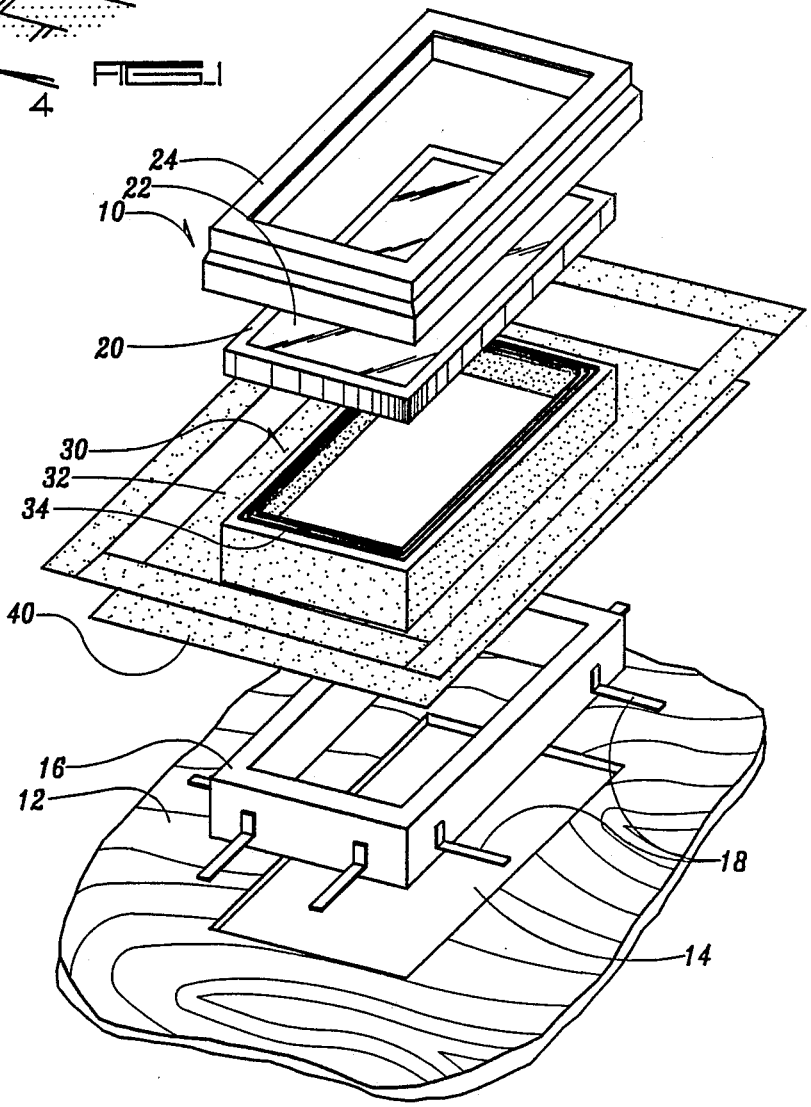
FIG. 2 is a fragmentary exploded view thereof.

As seen in FIG. 2, the skylight 10 includes a window assembly comprising a window frame 20, glazing 22 and a shroud 24.

Figure 4:
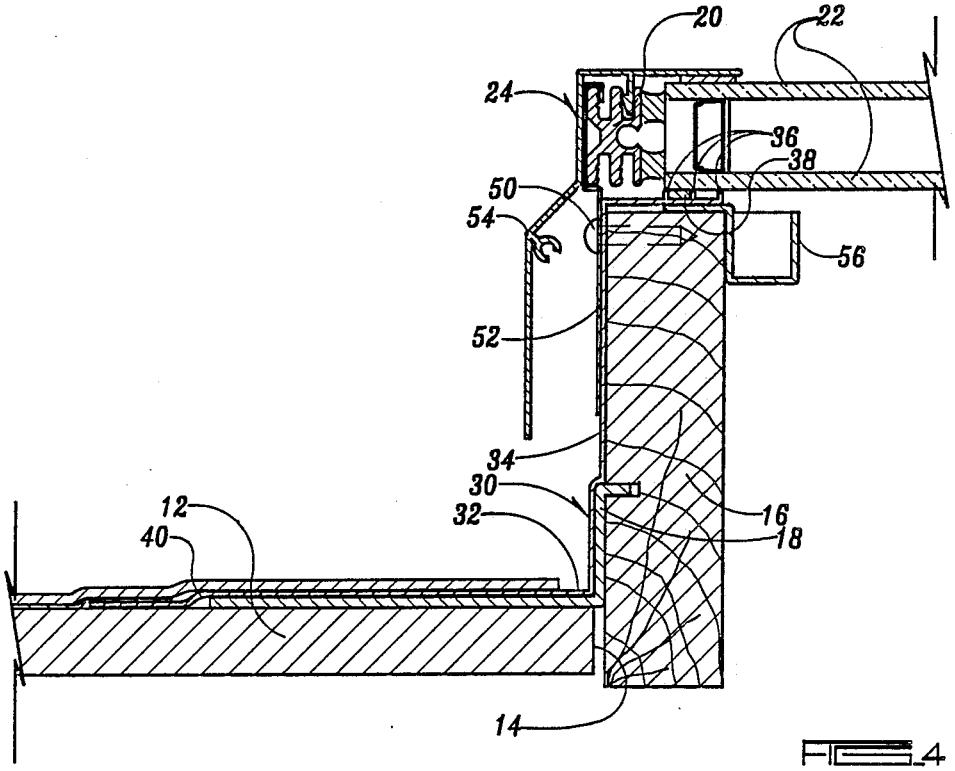
FIG. 4 is a cross-sectional view taken along line 4—4 in FIG. 1.

A one piece flexible elastomer, plastic or rubber, and, preferably EPDM, boot membrane flashing 30 is snuggingly fitted around the upstanding base frame 16 over its entire exterior exposed surface. The flashing 30 includes a laterally outwardly extending bottom peripheral flange portion 32 extending over the roof 12. The flashing further includes an upper laterally inwardly extending portion 34 overlapping the top edge of the base frame 16 as seen in FIG. 4. The upper flange portion 34 includes three upwardly extending ribs 36 which directly engage the glazing 22. Adhesive silicone 38 is placed between two of the ribs while the space between the other two ribs allows for excess silicone to be received and held.

The roof seal around the peripheral edge of the lower laterally outwardly extending flashing portion 32 is provided by a roofing membrane of tape 40 which extends over the flashing portion 32 and the roof 12. The tape includes a polypropylene coating on top and is preferably four inches wide. The tape is provided with adhesive on the bottom side. It may be obtained from the W. R. Grace Company and is sold under the trademark Ice and Water Shield.

In FIG. 4 it is further seen that screws 50 secure the shroud 24 to the base 16 and in turn lock the window frame 20 in place on top of the base frame 16. The shroud includes the mounting flange 52 through which the screw 50 extends and a counter flashing flange 54 spaced outwardly therefrom. Inwardly of the base frame 16 is a condensation gutter 56 to collect moisture should it be present on the glazing 22.

Figure 3:
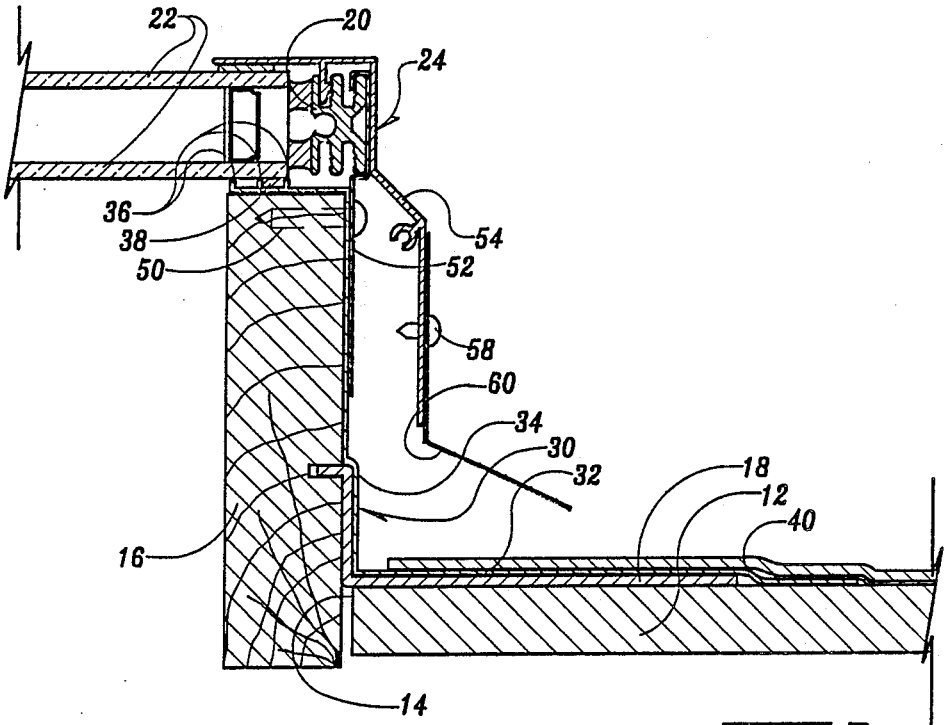
FIG. 3 is a cross-sectional view taken along line 3—3 in FIG. 1.
Figure 5:
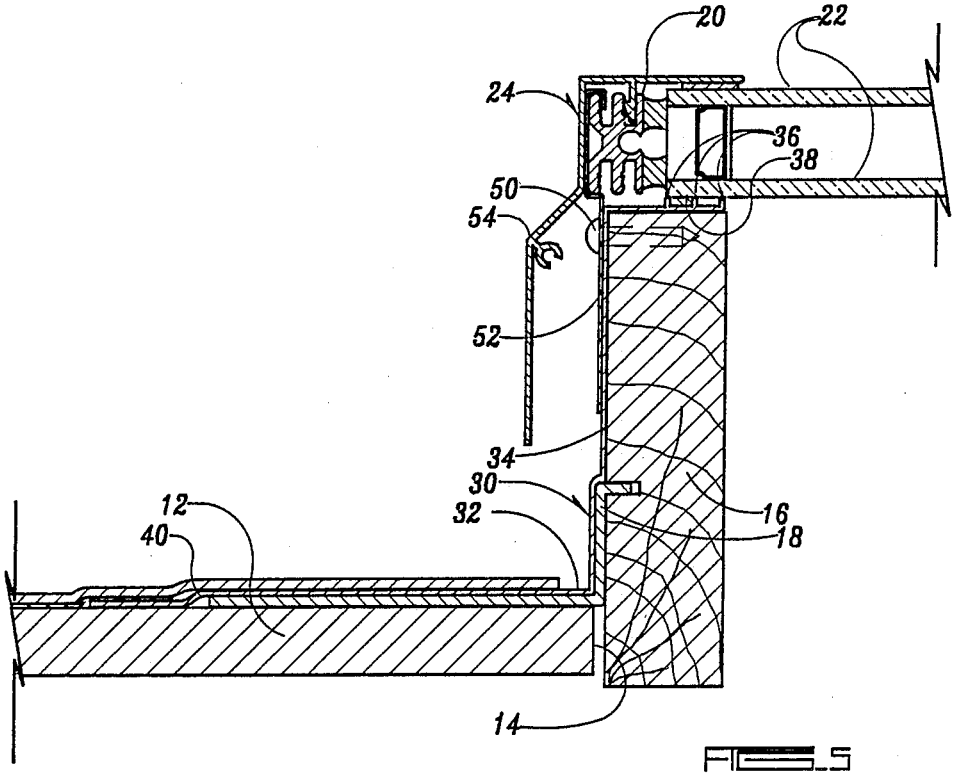
FIG. 5 is a cross-sectional view taken along line 5—5 in FIG. 1.

While FIG. 4 is a cross-sectional view through the sill of the skylight, FIG. 3 is a cross-sectional view through the head and shows a screw 58 for adjustably connecting a water diverter or deflector 60 to the lower end of the counter flashing 54. FIG. 5 is a cross-sectional view through the jam of the skylight.

Figure 6:
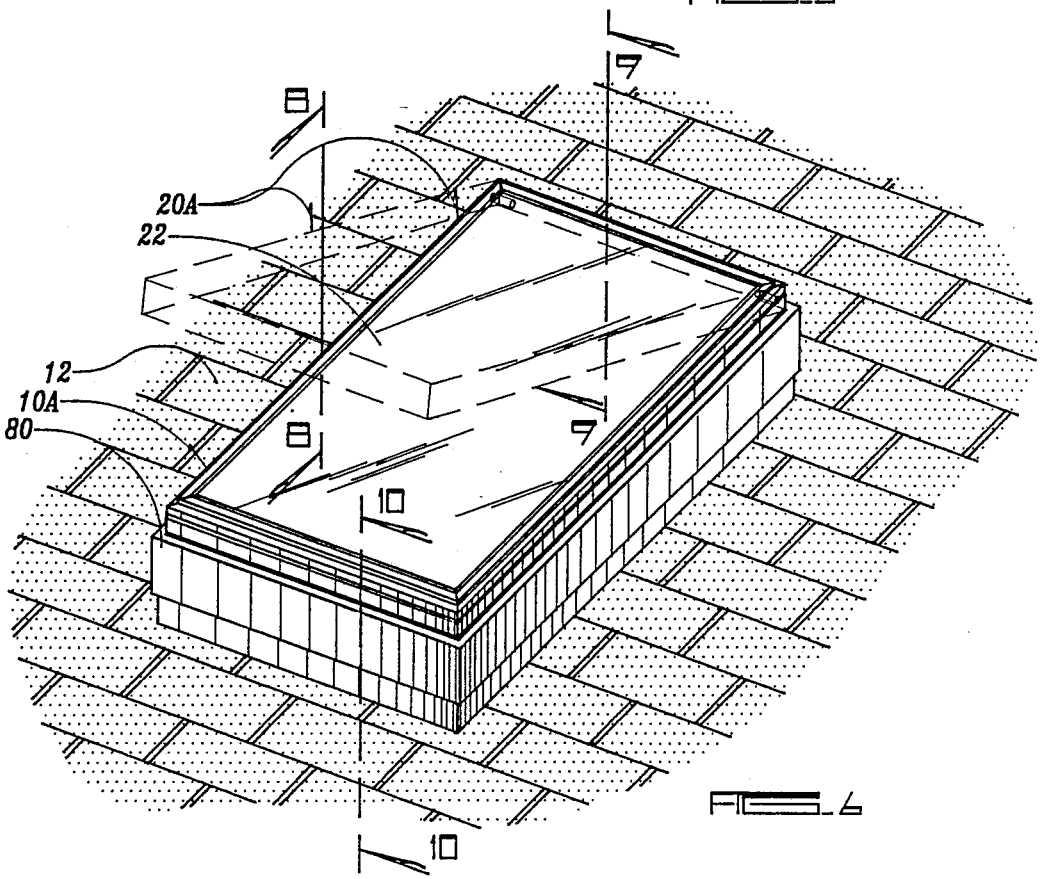
FIG. 6 is a fragmentary perspective view of an alternate embodiment wherein the skylight is vented by being capable of being opened and closed.
Figure 7:
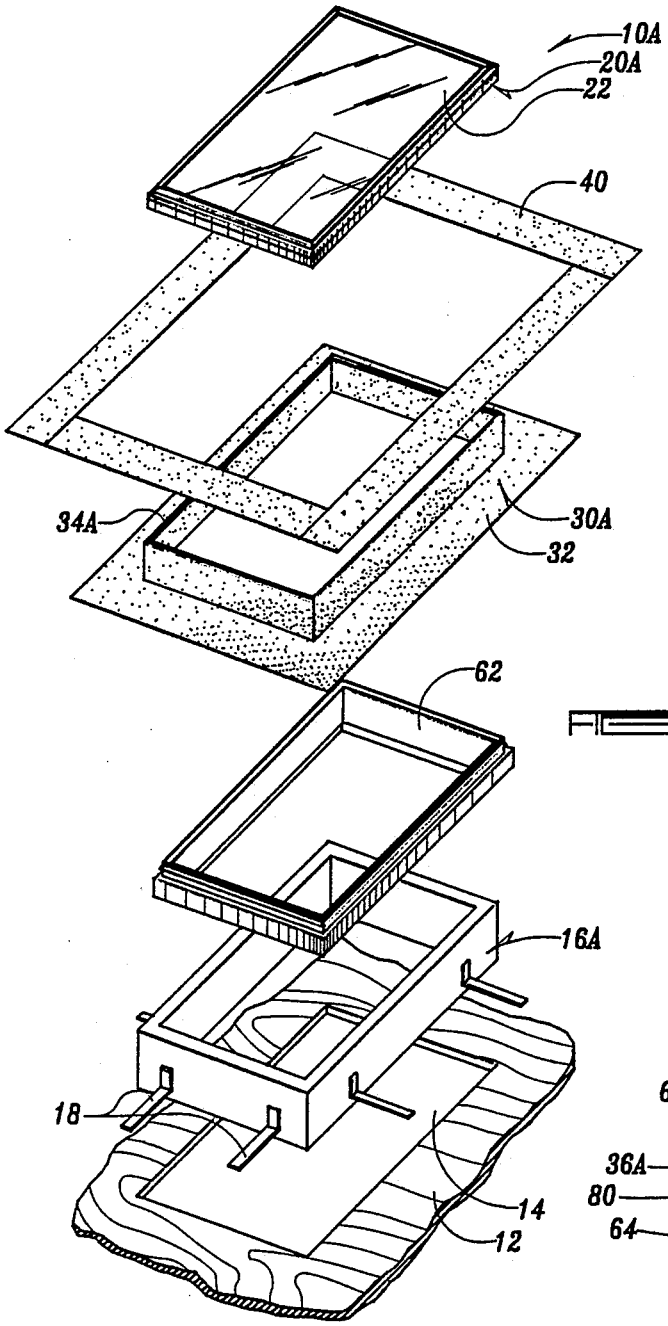
FIG. 7 is an exploded perspective view thereof.
Figure 8:
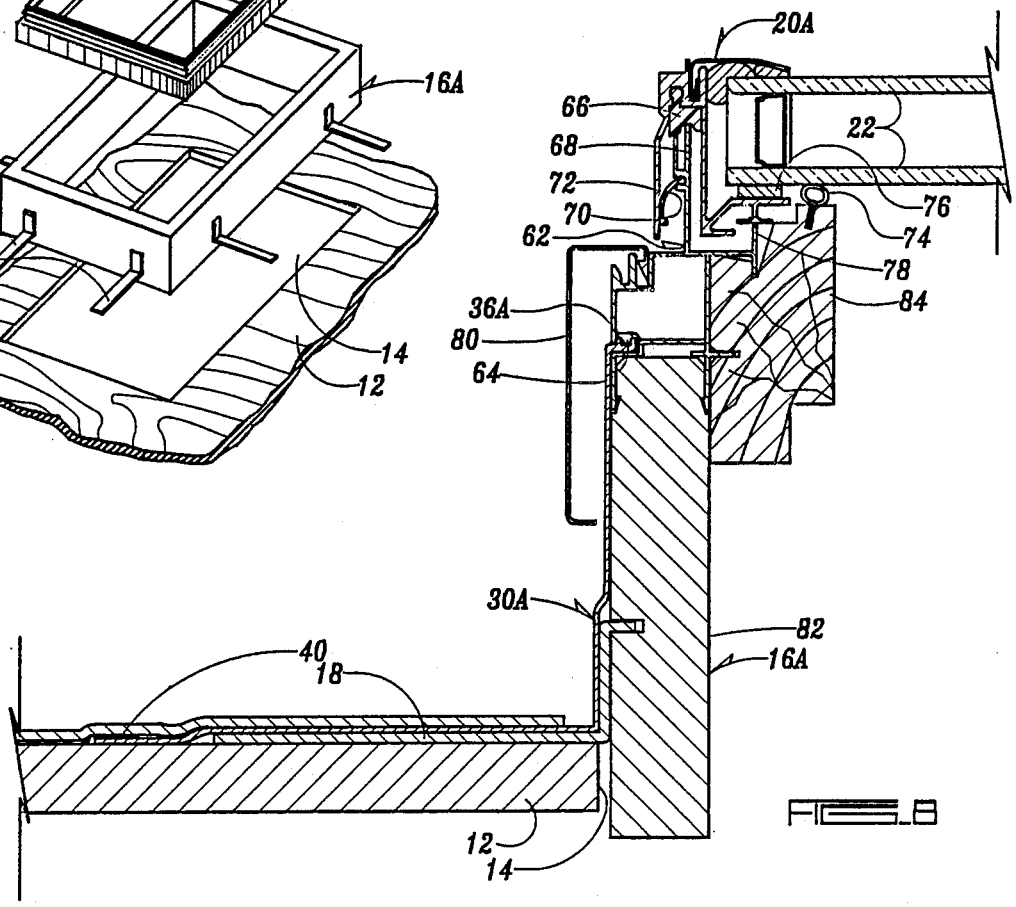
FIG. 8 is a cross-sectional view taken along line 8—8 in FIG. 6.
Figure 9:
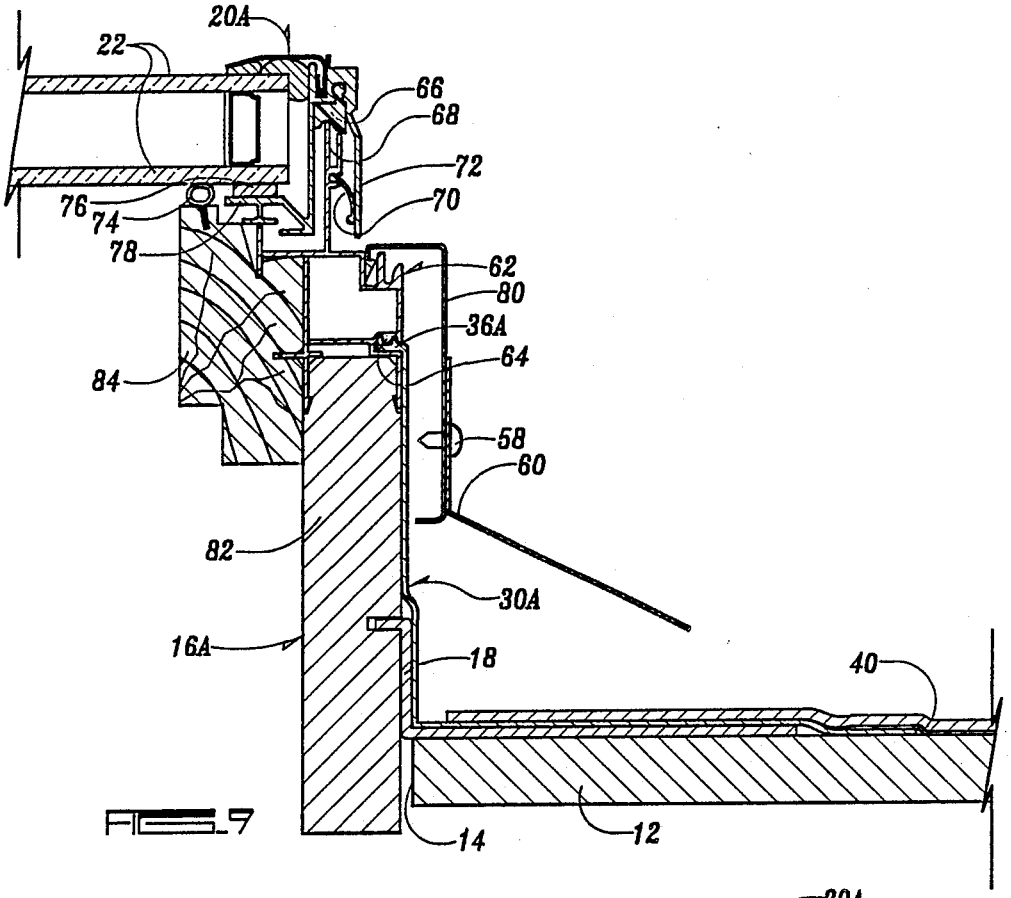
FIG. 9 is a cross-sectional view taken along line 9—9 in FIG. 6.

In FIGS. 6–10 a ventilator skylight 10A is illustrated and includes a base frame 16A mounted on a roof opening 14 in the roof 12. An aluminum extruded support 62 is mounted on the upper edge of the base frame 16A. The window frame 20A is pivoted to the aluminum extruded support 62 at its upper end as seen in FIG. 6 by the dash line representation of the window assembly and frame 20A.

The flashing boot 30A includes a lower outwardly extending flange portion 32 and an inwardly extending top flange portion 34A which includes a pair of upstanding ribs 36A received in a groove 64 on the bottom of the aluminum extruded support 62.

Figure 10:
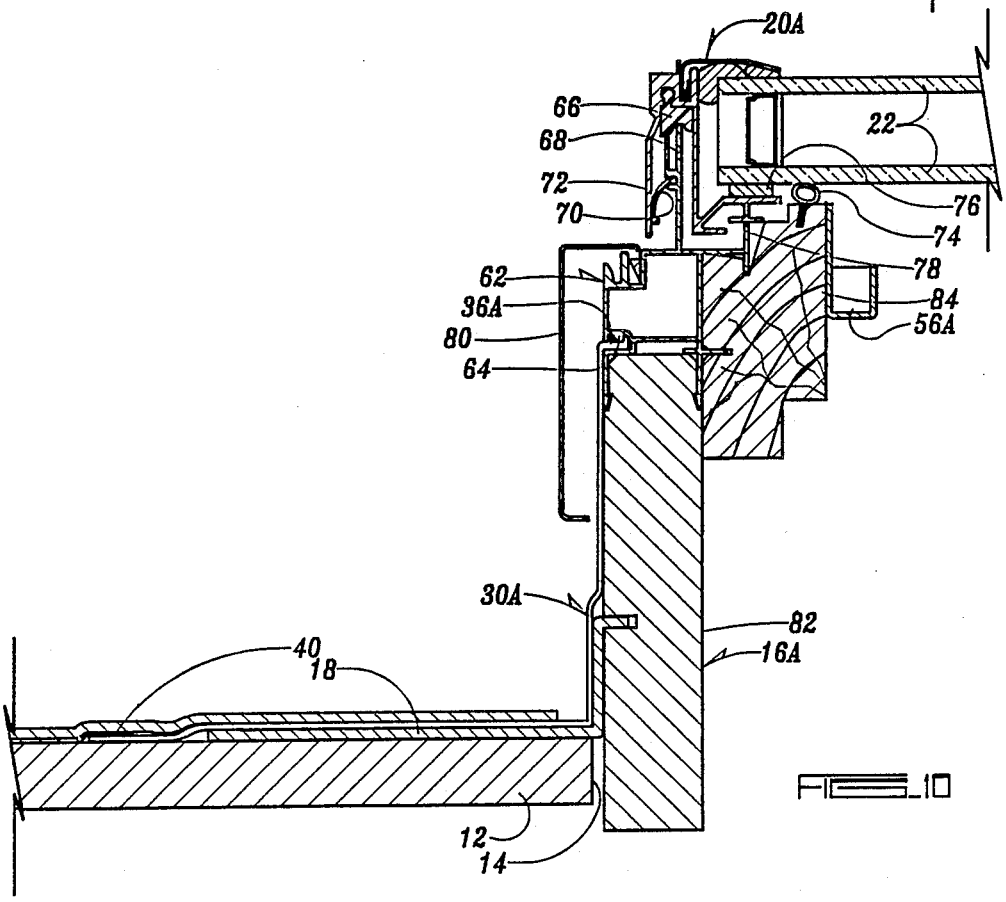
FIG. 10 is a cross-sectional view taken along line 10—10 in FIG. 6.

The remaining structure of the window assembly in window frame 20A pivotally mounted to the aluminum extruded support 62 is conventional. The window frame 20A includes a gasket 66 which engages the upstanding walls 68 of the support 62. The wall 68 include a leaf seal 70 which wipes against a downwardly extending wall 72 carried by the window frame 20A as seen in FIG. 10. An upstanding gasket 74 is provided on the upper edge of the base frame 16A which engages directly with the glazing 22. A support pad 76 is provided on a ledge 78 of the support 62 for engagement with the glazing 22. A condensation gutter 56A is also provided. A counter flashing 80 is detachably connected to the aluminum extruded support 62. The base frame 16A includes a lower frame member 82 to which an upper inwardly positioned frame member 84 is connected for partially supporting the aluminum extruded support 62.

Thus it is seen that the one piece flexible EPDM membrane flashing boots 30 and 30A are adaptable to both fixed and ventilating-type skylight base frames to provide a complete weather seal from the roof to the window unit. The flashing boot may be of preferably EPDM material but also may be of other flexible, resilient plastic material which may be molded or welded together to form an impervious one piece boot including top and bottom oppositely extending flange portions for sealing to the window unit and roof respectively.

I claim:

1. A skylight in a roof comprising, an upstanding base frame positioned on and extending around an opening in the roof, and a window assembly having a window unit including a window frame and window glazing positioned on said base frame, a one piece flexible elastomer boot membrane flashing snugly molded around said base frame over its entire exterior exposed surface and extending between engagement with the roof and said window unit to seal said roof from moisture passing therethrough around said opening, said flashing including an upstanding portion which extends along said upstanding base frame, and a bottom laterally outwardly extending portion overlapping said roof around the periphery of said base frame and opening, said flashing upstanding portion merging into a top laterally inwardly extending portion over the top of said upstanding base frame between said base frame and said window assembly, said window assembly including a support to which said window unit is pivotally connected and said flashing top laterally inwardly extending portion sealingly engaging said window support between said support and the top of said base frame, and said top laterally inwardly extending portion including an upstanding rib engaging said support.

2. The structure of claim 1 wherein said support includes a downwardly facing groove into which said upstanding rib is received.

3. A skylight in a roof comprising, an upstanding base frame positioned on an opening in the roof, and a window assembly having a window unit including a window frame and window glazing positioned on said base frame, a one piece flexible elastomer boot membrane flashing extending around said base frame and extending between engagement with the roof and said window unit to seal said roof from moisture passing therethrough around said opening, said flashing including an upstanding portion which extends along said upstanding base frame, and a bottom laterally outwardly extending portion overlapping said roof around the periphery of said base frame and opening, a top laterally inwardly extending portion extending over the top of said upstanding base frame between said base frame and said window assembly, said window assembly including a support to which said window unit is pivotally connected and said flashing top laterally inwardly extending portion sealingly engaging said window support between said support and the top of said base frame, and said top laterally inwardly extending flashing portion including an upstanding rib engaging said support.

4. The structure of claim 3 wherein said support includes a downwardly facing groove into which said upstanding rib is received.

* * * * *